US009725972B2

(12) United States Patent
Borst et al.

(10) Patent No.: US 9,725,972 B2
(45) Date of Patent: Aug. 8, 2017

(54) METHOD AND APPARATUS FOR DRILLING AND SERVICING SUBTERRANEAN WELLS WITH ROTATING COILED TUBING

(71) Applicant: REEL REVOLUTION HOLDINGS LIMITED, Dubai (AE)

(72) Inventors: Terence Borst, Dubai (AE); Dudley J. Perio, Jr., Austin, TX (US)

(73) Assignee: REEL REVOLUTION HOLDINGS LIMITED (VG)

( * ) Notice: Subject to any disclaimer, the term of this patent is extended or adjusted under 35 U.S.C. 154(b) by 360 days.

(21) Appl. No.: 14/271,836

(22) Filed: May 7, 2014

(65) Prior Publication Data

US 2014/0238696 A1 Aug. 28, 2014

Related U.S. Application Data

(60) Division of application No. 12/275,977, filed on Nov. 21, 2008, now Pat. No. 8,752,617, which is a continuation-in-part of application No. 11/174,372, filed on Jul. 1, 2005, now Pat. No. 7,469,755.

(60) Provisional application No. 60/584,616, filed on Jul. 1, 2004.

(51) Int. Cl.

| | |
|---|---|
| ***E21B 19/22*** | (2006.01) |
| ***E21B 17/20*** | (2006.01) |
| *E21B 19/08* | (2006.01) |

(52) U.S. Cl.

CPC ..... *E21B 19/22* (2013.01); *E21B 17/20* (2013.01); *E21B 19/08* (2013.01)

(58) Field of Classification Search

CPC ..... E21B 19/08; E21B 19/22; E21B 17/20

See application file for complete search history.

(56) References Cited

U.S. PATENT DOCUMENTS

| | | | |
|---|---|---|---|
| 4,616,705 | A | 10/1986 | Stegemeier et al. |
| 5,660,235 | A | 8/1997 | Sola |
| 5,848,642 | A | 12/1998 | Sola |
| 6,092,756 | A | 7/2000 | Sola |
| 6,315,052 | B1 | 11/2001 | Sola |
| 6,516,892 | B2 | 2/2003 | Reilly |
| 6,868,902 | B1 | 3/2005 | Roodenburg et al. |
| 2002/0125014 | A1 | 9/2002 | Dearing et al. |
| 2002/0195255 | A1 | 12/2002 | Reilly |

(Continued)

OTHER PUBLICATIONS

Leading Edge Advantage International Ltd., "Introduction to Coiled Tubing Drilling", 42 pages, Bucksburn, Aberdeen, copyright 2002 by LEA.

(Continued)

*Primary Examiner* — Brad Harcourt

(74) *Attorney, Agent, or Firm* — Sutton McAughan Deaver PLLC

(57) ABSTRACT

A system is provided for drilling and/or servicing a well bore using continuous lengths of coiled tubing in which a turntable assembly rotates a coiled tubing reel assembly and a counter balance system about the well bore such that the coiled tubing is rotated while in the wellbore. A coiled tubing injector may be provided on a separate turntable assembly or on the same turntable assembly as the reel assembly. A swivel support assembly may be provided for managing operation lines associated with the system.

9 Claims, 17 Drawing Sheets

(56) References Cited

U.S. PATENT DOCUMENTS

| | | | | |
|---|---|---|---|---|
| 2005/0161230 | A1 | 7/2005 | Webre et al. | |
| 2006/0000644 | A1 * | 1/2006 | Adam | E21B 7/046 175/61 |

OTHER PUBLICATIONS

Leading Edge Advantage International Ltd., "Introduction to Underbalanced Drilling", 51 pages, Bucksburn, Aberdeen, copyright 2002 by LEA.

* cited by examiner

METHOD AND APPARATUS FOR DRILLING AND SERVICING SUBTERRANEAN WELLS WITH ROTATING COILED TUBING

CROSS REFERENCE TO RELATED APPLICATIONS

This application is a continuation-in-part of U.S. application Ser. No. 11/174,372, filed on Jul. 1, 2005, which is currently pending.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The subject invention relates generally to drilling and/or servicing subterranean wells for recovery of hydrocarbon-bearing fluids and more specifically to a method and apparatus for drilling and/or servicing subterranean wells with rotating coiled tubing.

Description of the Related Art

Historically, subterranean wells have been drilled by rotating a bit attached to the end of jointed pipe or tubing sections. The jointed pipe string is rotated from the surface, which rotation is transferred to the bit. As the rotating bit drills into the earth, additional sections or joints of pipe must be added to drill deeper. A significant amount of time and energy is consumed in adding and removing new sections of pipe to the drill string.

Coiled tubing, such as described in U.S. Pat. No. 4,863,091, is available in virtually unlimited lengths and has been used for a variety of purposes in the exploration and production of hydrocarbons from subterranean wells. Coiled tubing has not, to date, supplanted jointed pipe for drilling operations.

It is believed that the most common use of coiled tubing in drilling operations involves the use of a motor or other energy source located at the end of tubing adjacent the drill bit. One type of motor is a mud motor that converts pressurized drilling mud flowing through the coiled tubing into rotational energy for the drill bit. In this type of system, the coiled tubing itself does not rotate. For example, U.S. Pat. No. 5,360,075 is entitled "Steering Drill Bit While Drilling A Bore Hole" and discloses, among other things, a motor powered drill bit at the end of coiled tubing that can be steered by torsioning the tubing. The article *Introduction to Coiled Tubing Drilling* by Leading Edge Advantage International Ltd. is believed to provide an overview of the state of the art of drilling using non-rotating coiled tubing, a copy of which may be found at www.lealtd.com. The substance of that article is incorporated by reference herein for all purposes.

Another approach for drilling with coiled tubing is taught in U.S. Pat. No. 4,515,220, which is entitled "Apparatus and Method for Rotating Coil Tubing in a Well" and discloses, among other things, cutting the coiled tubing away from the spool before the tubing can be rotated for drilling operations.

U.S. Pat. No. 6,315,052 is entitled "Method and a Device for Use in Coiled Tubing Operations" and appears to disclose an apparatus that physically rotates a spool of coiled tubing about an axis to thereby drill the well bore. U.S. Pat. No. 5,660,235 is similarly entitled "Method and a Device for Use in Coil Pipe Operations" and discloses, among other things, maintaining the coiled tubing in substantial alignment with the injector head as the tubing is spooled and unspooled by rotating the reel about a pivot point and/or translating the reel relative to the injector head.

The present invention builds on the prior art and is directed to an improved method and apparatus for drilling and/or servicing subterranean wells with rotating coiled tubing.

SUMMARY OF THE DISCLOSURE

In one aspect of the present invention, a system for drilling or servicing a well with coiled tubing is provided that comprises a rotatable base or turntable comprising a bearing system rotatably fixing the base to a floor, and a reel assembly comprising a support structure adapted to support a reel of coiled tubing. The support structure comprises an alignment system to align the coiled tubing with the well as the coiled tubing is payed off the reel. The reel assembly is located near a periphery of the base and a coil tubing injector head is aligned with the well. A counterbalance assembly is located on the base opposite the reel assembly and is moveable toward and away from the reel assembly to maintain balance of the system, as coiled tubing is payed off the reel. A motive system is provided for turning the base and thereby transmitting torque to the coiled tubing in the well. A swivel support assembly is provided for managing operation lines associated with the system.

In another aspect of the present invention, the system may be disposed as part of a mobile or permanent rig that may be moved from location to location.

The foregoing summary is not intended to summarize each potential embodiment of the present invention, but merely summarizes the illustrative embodiments disclosed below.

BRIEF DESCRIPTION OF THE DRAWINGS

The foregoing summary, detailed description of preferred embodiments, and other aspects of this disclosure will be best understood when read in conjunction with the accompanying drawings, in which.

Figure 1:
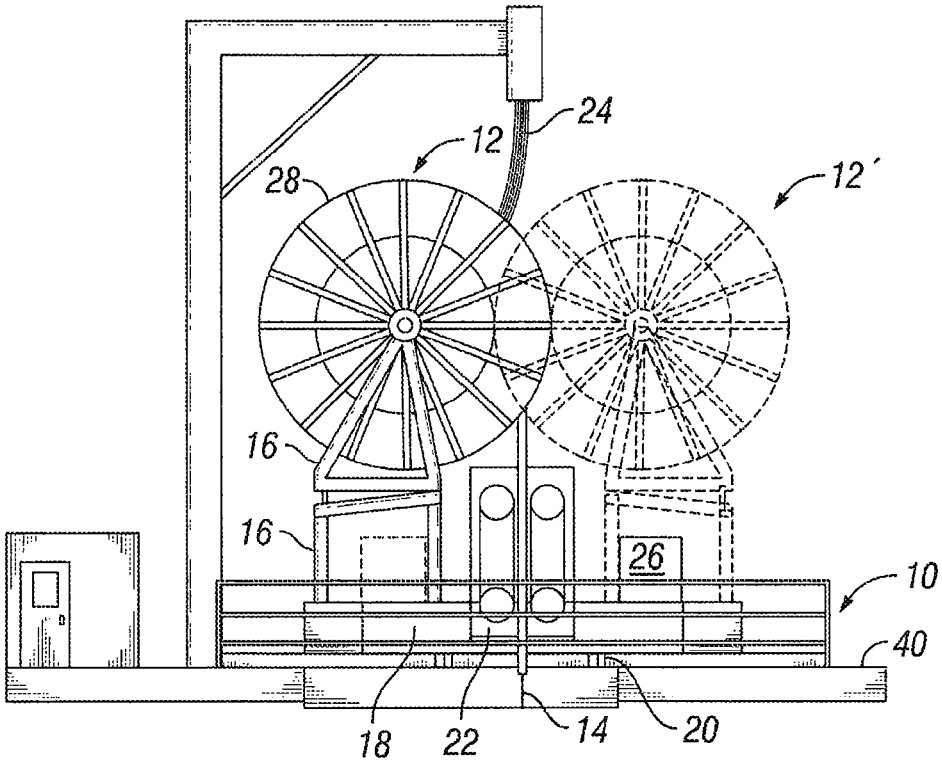
FIG. 1 illustrates a side view of a reel assembly and turntable assembly according to the present invention.

The figures above and detailed description below are not intended to limit in any manner the breadth or scope of the invention conceived by applicants. Rather, the figures and detailed written description are provided to illustrate the invention to a person of ordinary skill in the art by reference to the particular, detailed embodiments disclosed.

DETAILED DESCRIPTION

Illustrative embodiments of the invention are described below. In the interest of clarity and disclosure of what Applicants regard as their invention, not all features of an actual implementation are described in this specification. It will of course be appreciated that in the development of any such actual embodiment, numerous implementation-specific decisions must be made to achieve the developers' specific goals, such as compliance with system-related, business-related, and government-related constraints, which will vary from one implementation to another. Moreover, it will be appreciated that such a development effort might be complex and time-consuming, but would nevertheless be a routine undertaking for those of ordinary skill in the art having the benefit of this disclosure.

In general terms, the present inventions provide an improved method, system and/or drilling/service rig that can rotate continuous lengths of coiled tubing down hole for drilling and other exploration and/or production operations. A system is disclosed in which at least one reel of coiled tubing is located on a rotatable platform oriented about the well bore. The reel of tubing is adapted to adjust its position relative to the well bore centerline, as tubing is payed on and off. A dynamic counterbalance system may also be provided to offset the dynamically changing weight of coiled tubing and may be adapted to translate toward and away from the well bore as may be needed to maintain rotational balance. A coil tubing injector head may be disposed adjacent the well bore for injecting and retracting coiled tubing from the well. The present invention allows the use of conventional or third party tubing reels or proprietary reels and conventional or proprietary coiled tubing handling equipment, such as coiled tubing injector heads. The present invention may be incorporated on a trailer or other mobile structure for fast rig-up and rig-down, and ease of transportation from well site to well site. Such mobile structure may incorporate trailer axles and wheels designed with adequate spacing to clear the external walls of the well cellar or other well structures.

The present invention may further include a swivel support assembly, which may include a swivel support rotational mast, for managing operation lines associated with one or more components of the system described above. The swivel support assembly may include a rotating junction, or swivel, having one or more passages for supporting operation lines, such as, for example, fluid, pneumatic, hydraulic, electrical or other lines associated with one or more pieces of equipment. The swivel support assembly may include one or more support members for bearing the weight of the swivel and other components of the assembly. The support members may allow the swivel and/or other components to be positioned as required by a particular application, for example, relative to a wellbore, or to be removed from a particular location, such as to supplement access to a wellbore. Furthermore, the support members may allow the swivel support assembly to be folded, erected, broken-down, stored, or relocated, in whole or in part. The swivel support assembly may support the weight of the swivel, control hoses or lines, and/or other equipment, and may provide support for all associated loads. In addition, the swivel support assembly may, but need not, allow loads, such as torque, to be transmitted to its structure, or other structures, which may, for example, relieve one or more components of the system from one or more forces, such as torques, stresses, strains, or other loads.

The present invention, at least one embodiment of which is described in more detail below, greatly improves the efficiency at which both over balanced and under balanced wells can be drilled and completed; improves the safety associated with re-entering, side-tracking and working over live or depleted wells; and greatly reduces the time spent in the reservoir and during rig-up and rig-down, as compared to conventional drilling operations. As compared to conventional drilling operations, the present invention allows for smaller crew numbers, reduced rotational friction, increased rate-of-penetration, reach, and the ability to safely and simultaneously drill, produce, and log the well bore.

Figure 2:
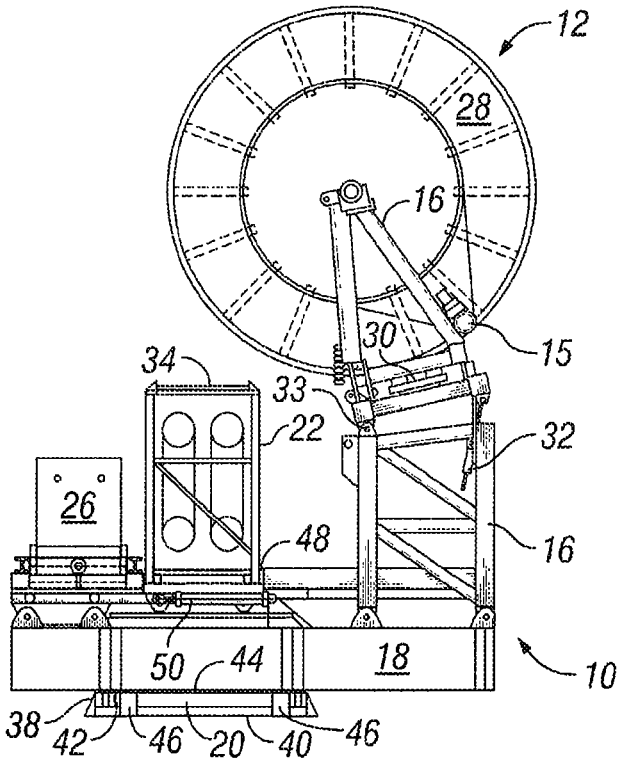
FIG. 2 illustrates a more detailed view of the assemblies shown in FIG. 1.

Turning now to FIGS. 1 and 2, an embodiment of the present invention is shown in more detail to aid the understanding of the broader aspects of the inventive concept. FIG. 1 is a side view of one embodiment of a portion of the system first described above. The system comprises a turntable assembly 10, and a reel assembly 12 (with the reel assembly in a rotated position at 12'). The turntable assembly 10 comprises a base 18 and bearing assembly 20. The reel assembly 12 comprises a reel 28 containing coiled tubing 14, a support structure 16, coiled tubing injector head 22, control lines 24 and a counterbalance system 26. A power system (not shown) provides all the necessary power for the system. In the preferred embodiment, a separate mobile power system comprises a 300 HP diesel engine for generating electric and hydraulic power.

Figure 3:
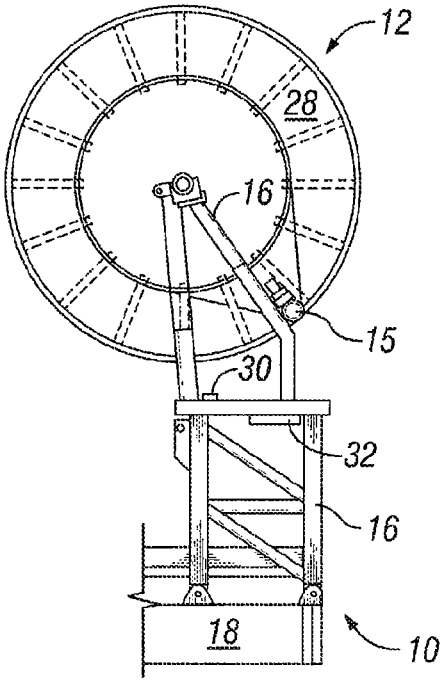
FIG. 3 illustrates an alternative reel assembly to that shown in FIG. 2

The reel 28 preferably has a capacity of at least about 13,000 feet (4,000 meters) of 3¼ inch (8.255 cm) outside diameter by ¼ inch (0.635 cm) wall thickness coiled tubing 14. Although 3¼" tubing is not widely available, it has been found that such tubing has an optimum balance of fatigue and torsional strengths. Precision Tube Technology of Houston, Tex. offers 3¼" coiled tubing. Of course, the present invention has application with all types and sizes of coiled tubing. The reel assembly 12 further comprises a hydraulic cylinder 30 (FIG. 2) that maintains the tubing centered substantially directly above the injector head 22. As the tubing is spooled on and off the reel 28, the entire reel 28 is translated (in and out of the page as shown in FIGS. 1 and 2), as needed. In addition, the reel assembly 12 comprises an hydraulic cylinder 32 that moves or rotates the reel 28 about pivot point 33 towards and away from the injector head 22 as each wrap of coiled tubing 14 spools on or off to thereby maintain the spooling tubing 14 centered with the injector 22. More preferably, as shown in FIG. 3, the hydraulic cylinder 32 is adapted to translate the reel 28 toward and away from the well bore, instead of pivoting the reel 28 about pivot point 33.

The reel assembly 12 also comprises a reel drive and tensioning system 15 that is capable of spooling tubing 14 at about 2,500 psi or less. The drive system 15 may comprise one or more hydraulic motors located adjacent the periphery of the reel 28 and engaging a chain or other gear on the outer periphery of the reel 28. Alternatively, a hydraulic motor may be located adjacent the center axis of this reel 28 for driving and tensioning the tubing. It will be appreciated that because the preferred embodiment of the present invention is a mobile rig, attention must be given to traveling weights and orientation of components. For example, a cantilevered hydraulic motor adjacent the reel 28 axis may be prone to fatigue failures. The presently preferred embodiment for the drive system 15 comprises a single hydraulic motor and chain as shown in FIG. 2.

Figure 4:
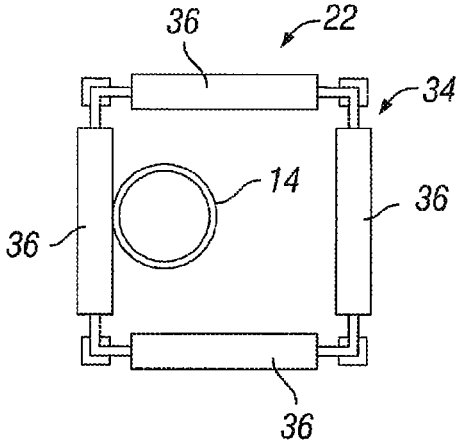
FIG. 4 illustrates a top view of a transducer system atop an injector head according to the present invention.

Mounted above or on the top of the injector head 22 is a transducer system 34 that senses the orientation or alignment of the coiled tubing with respect to the injector head 22. As shown in FIG. 4, a transducer system 34 suitable for use with the present system comprises four rollers 36 effectively surrounding the tubing 14. The transducer system 34 further comprises electronic, electrical or hydraulic sensors that detect when the coiled tubing 14 is in contact with one or more rollers 36. When the tubing 14 makes contact with a roller or rollers 36, the transducer system 34 sends a signal to the appropriate controller (e.g., human operator, programmable logic controller (PLC) or other logic device) and the appropriate hydraulic cylinder or cylinders, 30 or 32, are energized to move reel assembly 12 and hence tubing 14 back into centered alignment with the injector head 22. It will be appreciated that the range of movement of the tubing 14 with respect to the tubing injector 22 is controlled by the arrangement of the rollers 36 and sensitivity of the transducer system 34, which may be optimized for the specific tubing 14 being used. In a preferred embodiment using 3¼ inch OD tubing, the transducer system 34 allows the tubing to deviate no more than about ½ inch from the well centerline in any direction before corrective or restorative action is taken.

In an alternate embodiment, a PLC or other logic device, rather than the transducer system may directly control the alignment of the tubing described above. For example, as tubing is spooled on or off, the footage spooled can be sent to a logic device by an appropriate transducer (such as an odometer). A simple logic program can convert the amount of tubing spooled into the correct orientation of the reel assembly and send the appropriate control signals to the alignment system, such as the hydraulic cylinders. The transducer system 34 shown in FIG. 3 may be used with such a logic-based alignment system for fail-safe and/or limit functions.

Returning to FIG. 2, the preferred bearing assembly 20 for the main turntable 10 is a 120 inch diameter double mounted bearing, such as model number D20-111N1 offered by Kaydon of Dallas, Tex. The outer part 38 of the bearing assembly 20 is attached, for example, to the rig floor 40 and the inner section 42 of the bearing assembly 20 is mounted to the base 18. The mounting arrangement of the bearing assembly 20 may be changed depending upon design considerations. A ring gear 44 may be mounted to the inner section of the bearing assembly 20 and/or base 18. Two hydraulic low speed, high torque motors complete with failsafe pressure release brakes and drive gear 46 are preferably mounted to the rig floor. The drive gears mesh with the ring gear 44 in two places preferably 180° apart. In the preferred embodiment, these motors 46 provide a combined torque of about 8,500 to 13,000 ft-lbs. at the tubing 14 and at speeds from about 0 to 20 and to 50 revolutions per minute in either direction.

Figure 5:
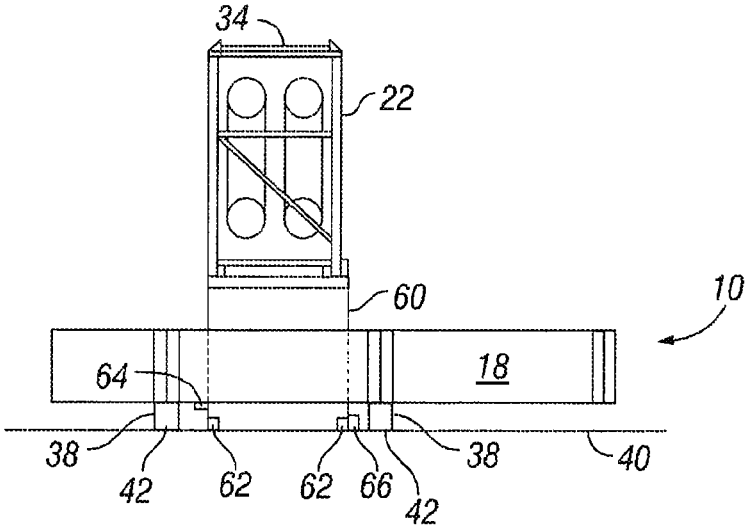
FIG. 5 illustrates a preferred embodiment of an injector turntable for use with the present invention.

In a presently preferred embodiment, the tubing injector 22 is a Hydra-Rig model HR-5100, 100,000 lb. capacity injector head assembly. The HR 5100 is designed to handle coiled tubing sizes from 1¾-inch OD through 3½-inch OD. It is designed for operation with both open loop and closed loop hydraulic systems. As illustrated in FIG. 5, it is preferred that the injector 22 not be rigidly coupled to the main turntable assembly 10. In other words, it is preferred that the injector 22 be free to rotate relative to the reel 28 and, therefore, the main turntable 10. This lack of rigid coupling allows the operator to monitor reactive or differential torque. As shown in FIG. 5, the injector 22 is preferably mounted on a separate turntable 60 so that relative rotation between main turntable 10 and injector turntable 60 is possible. The injector turntable 60 may comprise, for example, a section of large diameter pipe, to which the injector 22 may be mounted at one end. The other end of the pipe may be rotatably coupled to a structure, such as the rig floor 40, through a conventional bearing system 62.

When there are little or no reactive forces downhole working on the coiled tubing, the injector 22 and the main turntable 10 will rotate substantially together. However, as reactive forces, such as frictional drag, increase down hole, rotation of the injector 22 may lag behind the rotation of the main turntable 10 with the amount of lag being indicative of the reactive forces being experienced down hole. These reactive forces may be quantified in several different ways. For example, an instrumented torque arm 64 may be disposed between the injector turntable 60 and the main turntable 10. As the down hole reactive forces increase, the strain, for example, on the torque arm 64 would increase, thereby providing a measure of the reactive forces downhole. Alternately, a motor 66 could separately power the injector turntable 60. A control system, such as the PLC mentioned above, may be used to drive the injector table 60 in sync with the main turntable 10. As the downhole reactive forces increase, it will be appreciated that more power will have to be supplied to the injector turntable motor 66 to keep the injector in synch with the reel 20 and main turntable 10. Of course, it is also contemplated that the injector 22 can be coupled to the main turntable 10 so that there can be no relative rotation there between.

Depending upon the injector 22 system chosen, it may be beneficial to mount the injector 22 on a sliding base that allows it to be moved out of the way for clear access to the well. When fully retracted, the injector 22 may be stored within the support structure 16. When the system is being moved (e.g., to a different well), the injector may be stored within the support structure 16.

Returning to FIG. 2, directly opposite the reel assembly 12 is the counter balance system 26. This system 26, which comprises in it simplest form a bucket or box for holding scrap steel and iron as a counter balancing weight, assists in balancing the load of the reel assembly 12. One or more, and preferably two, hydraulic cylinders 50 are adapted to move the weights toward and away from the reel assembly 12 as needed to maintain a substantially balanced load on the bearing assembly 20. For example, as the center of mass of the reel 28 moves toward the wellbore axis, the center of mass of the counterbalance should likewise move toward the wellbore axis, and vice versa. Another one or more hydraulic cylinders are used to move the counter weights to the left and right opposite to the reel direction as the tubing is deployed or retrieved. It will be appreciated that this type of hydraulic control can be implemented by appropriate plumbing of the control lines. In addition, more complex control systems, such as a PLC-based system may also be used.

Figure 6:
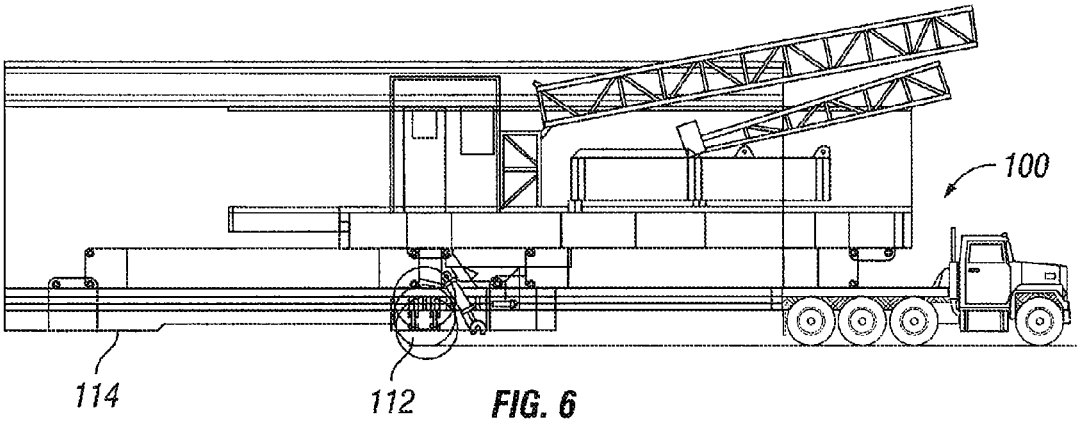
FIG. 6 illustrates an alternate embodiment of the present invention as a mobile rig.

Turning now to FIGS. 6-16, embodiments of other aspects of present system and its use will be described. FIG. 6 illustrates a preferred embodiment, which is a mobile drilling/service rig 100 incorporating numerous aspects of the present invention. The mobile rig 100 may be driven or trailered to a specific well site or location where it is backed up to straddle the well site (e.g., well head) and properly aligned thereto. The trailer axles and wheels are preferably designed and constructed with adequate spacing to clear the external walls of the well cellar or other well structures. The rig substructures may be fabricated from structural grade steel to support a rotary load of about 441,000 $lb_f$ (200 tonne) and may accommodate a rotating table set flush with the drill floor. Simultaneously or nearly so, mobile auxiliary systems providing power and control capabilities (not shown) may be brought on site and connected as appropriate.

Figure 7:
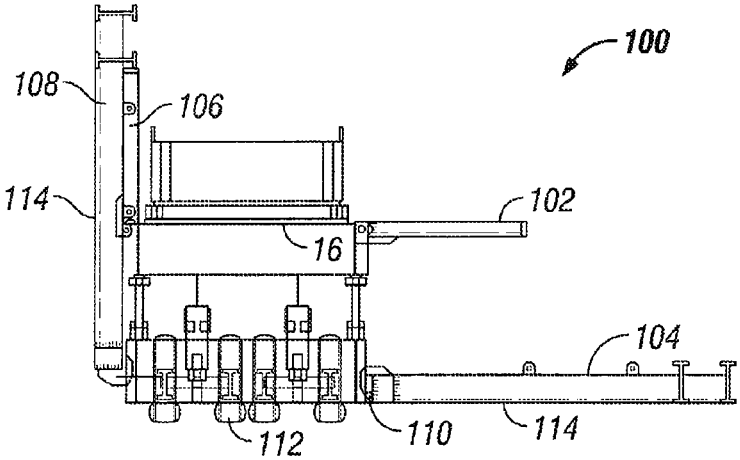
FIG. 7 illustrates an end view of the mobile rig in FIG. 5.

FIG. 7 is an end view of the mobile rig 100 and shows the right side upper 102 and lower 104 rig floor sections lowered from their travel position to the horizontal or working position. The left side floor sections 106, 108 are also lowered into position and all sections are locked into place with, for example, pins 110. A variety of mechanisms may be used to lower the floor sections into position (and raise them for traveling). Such as, but not limited to, hydraulic cylinders, cable systems, or manual jacks. In the embodiment shown in FIG. 7, one or more pole trucks (not shown) are used to lower the floor sections into the working position. To the extent that the rig 100 has wheels 112, they may be retracted or removed such that the bottom of the lower rig floor 114 rests on the ground or other suitable foundation. The upper rig floor, comprising left and rights sections 106, 102 and center section 116, incorporates level indicators and, as needed, the upper rig floor is leveled, for example, by shimming. It believed to be beneficial to lower and lock the lower rig floor in position prior to retracting the wheels 112.

Figure 8:
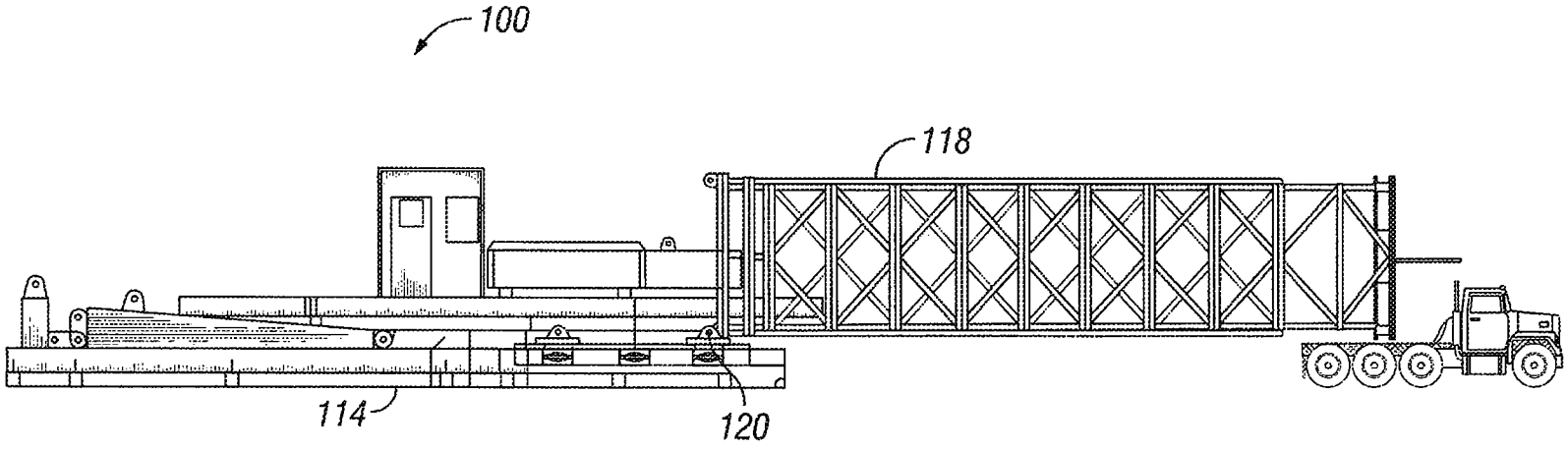
FIG. 8 illustrates attaching a collapsible mast to a mobile rig.
Figure 9:
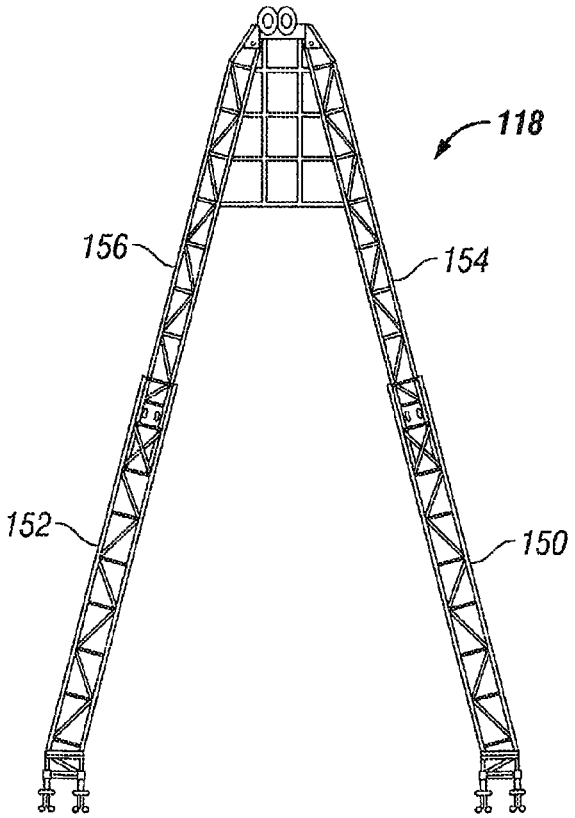
FIG. 9 illustrates another view of the collapsible mast.

FIG. 8 shows a collapsible mast 118 that is suitable for use with the mobile rig 100. During transit, the mast top section may be locked inside the lower section. Once on site, the mast 118 may be extended by the use of a hydraulic winch and a wireline system (not shown), or other suitable system. The mast 118 is illustrated with two of four lower connection points 120 pinned to the lower floor of the mobile rig 100. The collapsible mast 118 may be extended by a variety of means, such as, but not limited to the tractor shown in FIG. 8, and locked into position, by, among other things, pins. FIG. 9 is another view of the collapsible mast 118, and shows that the mast 118 may be designed to have a spread of 35 feet at the rig drill floor and a clear hook height of about 55 feet. The crown may be cantilevered to the front of the rig. The crown may accommodate one or more hoists and preferably a 100-ton hoist that will have the ability to travel from the well center to the edge of the lower rig floor. The mast 118 may be comprised of lower sections 150, 152 and upper sections 154, 156. The rotating system shown in FIGS. 1 and 2 will rotate inside the footprint of the mast 118.

Figure 10A:
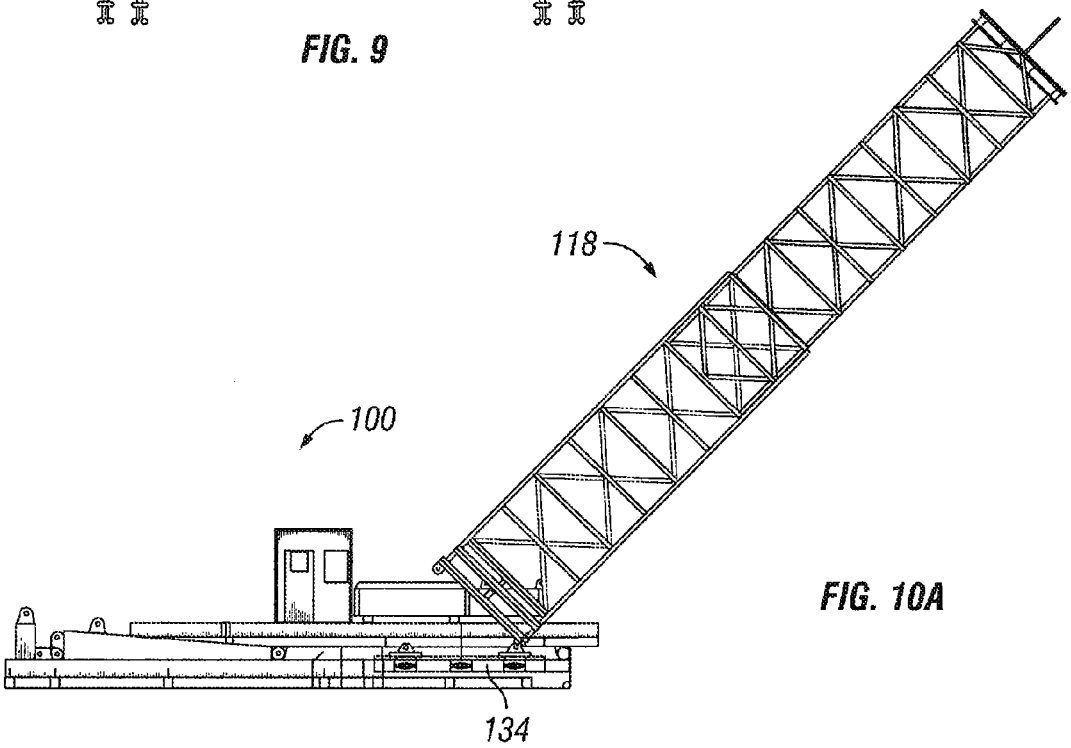
FIGS. 10*a* and 10*b* illustrate a collapsible mast raised and attached to a mobile rig.
Figure 10B:
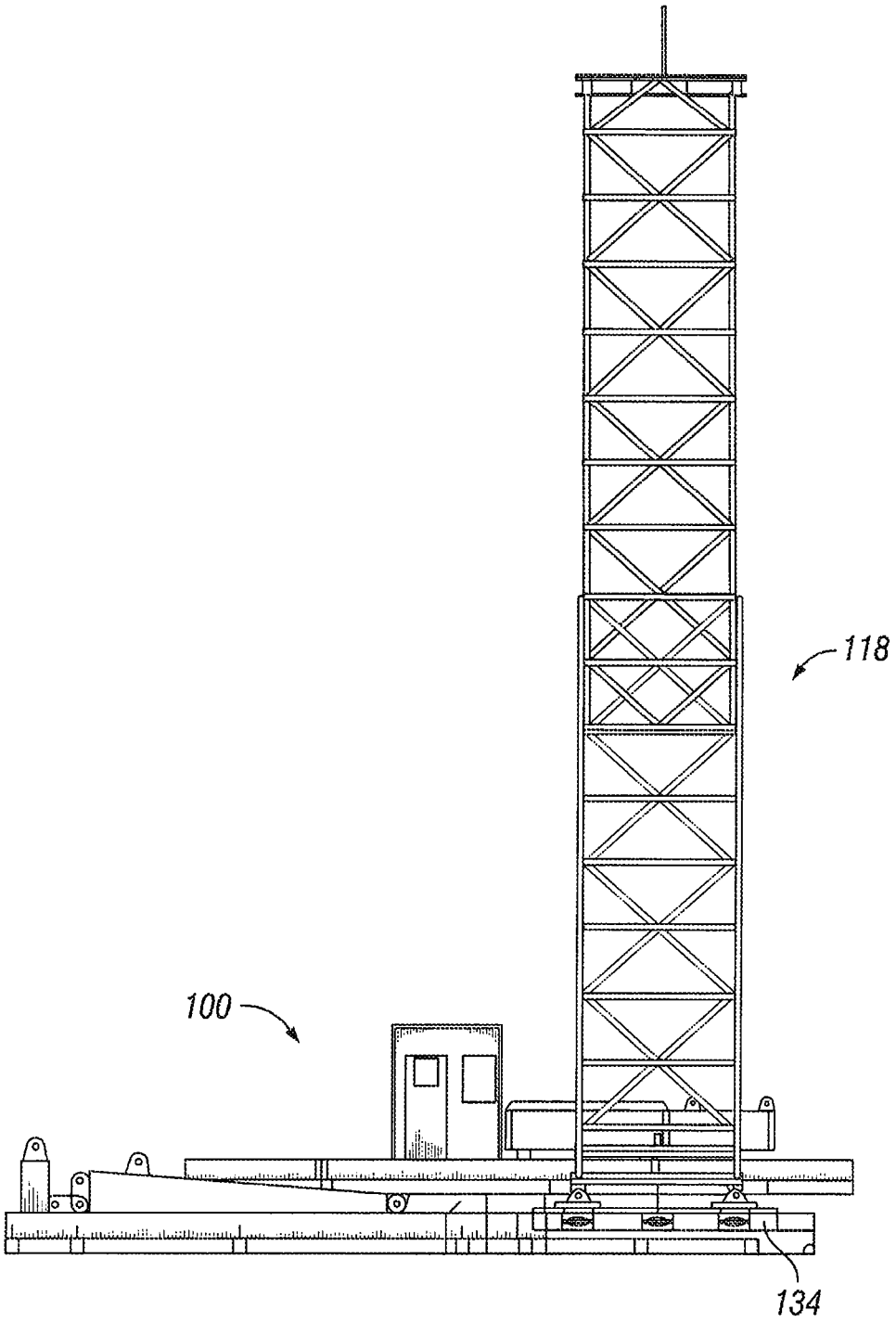

In FIGS. 10*a* and 10*b*, the collapsible mast 118 has been raised into position relative to the mobile rig 100. The mast 118 may be raised into vertical position and lowered into horizontal position by a variety of systems well known in the art, including two double acting three stage hydraulic cylinders. Controls for both hydraulic devices may be located at an operator's control panel positioned near the mast 118 base section. The top sections of mast 118 latches into the lower sections. As an additional safety feature, a manual safety lock may be provided. Latches provide easy visual verification of proper function from ground position. Further safety features may include orifices in the raising cylinders that will control mast descent speed in the event of hydraulic system failure during rig-up or rig-down.

Figure 11:
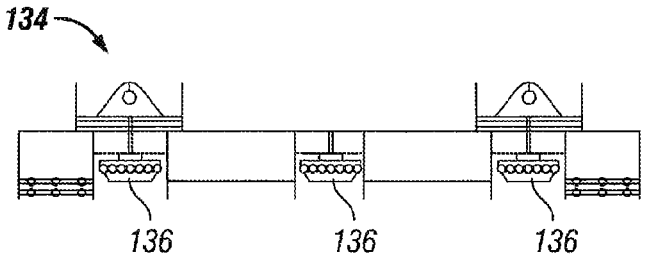
FIG. 11 illustrates a sliding system for a collapsible mast.

FIG. 11 illustrates a mast bottom 134, which is suitable for use with mast 118. The bottom comprises a plurality of Hillman rollers 136. The rollers 136 may have a retracted and a lowered position, in which the lowered position allows the mast 118 to be moved or rolled about the lower rig floor. Movement of the mast 118 may be accomplished by hydraulic or electric motors or draw works systems, to name a few. Encoders and/or limit switches may be employed to track the movement of the mast 118 and/or to limit its travel.

Figure 12A:
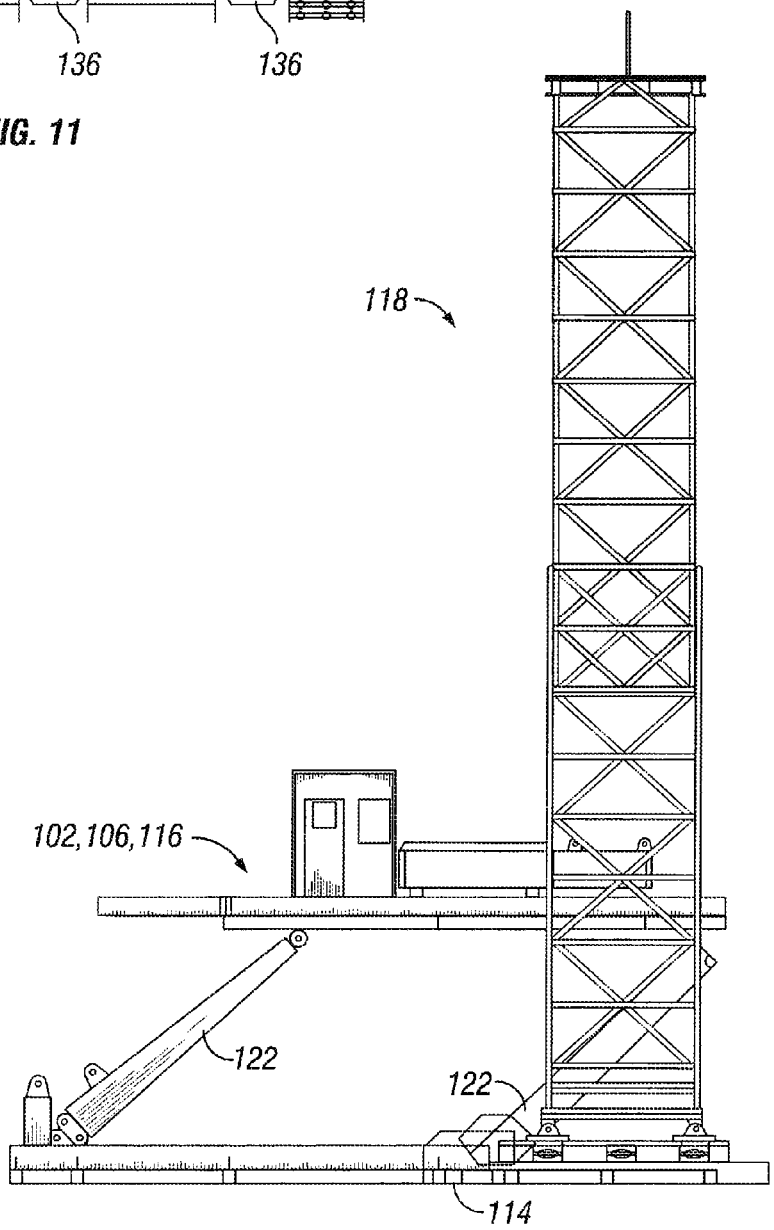
FIGS. 12*a* and 12*b* illustrate raising the upper floor of a mobile rig.
Figure 12B:
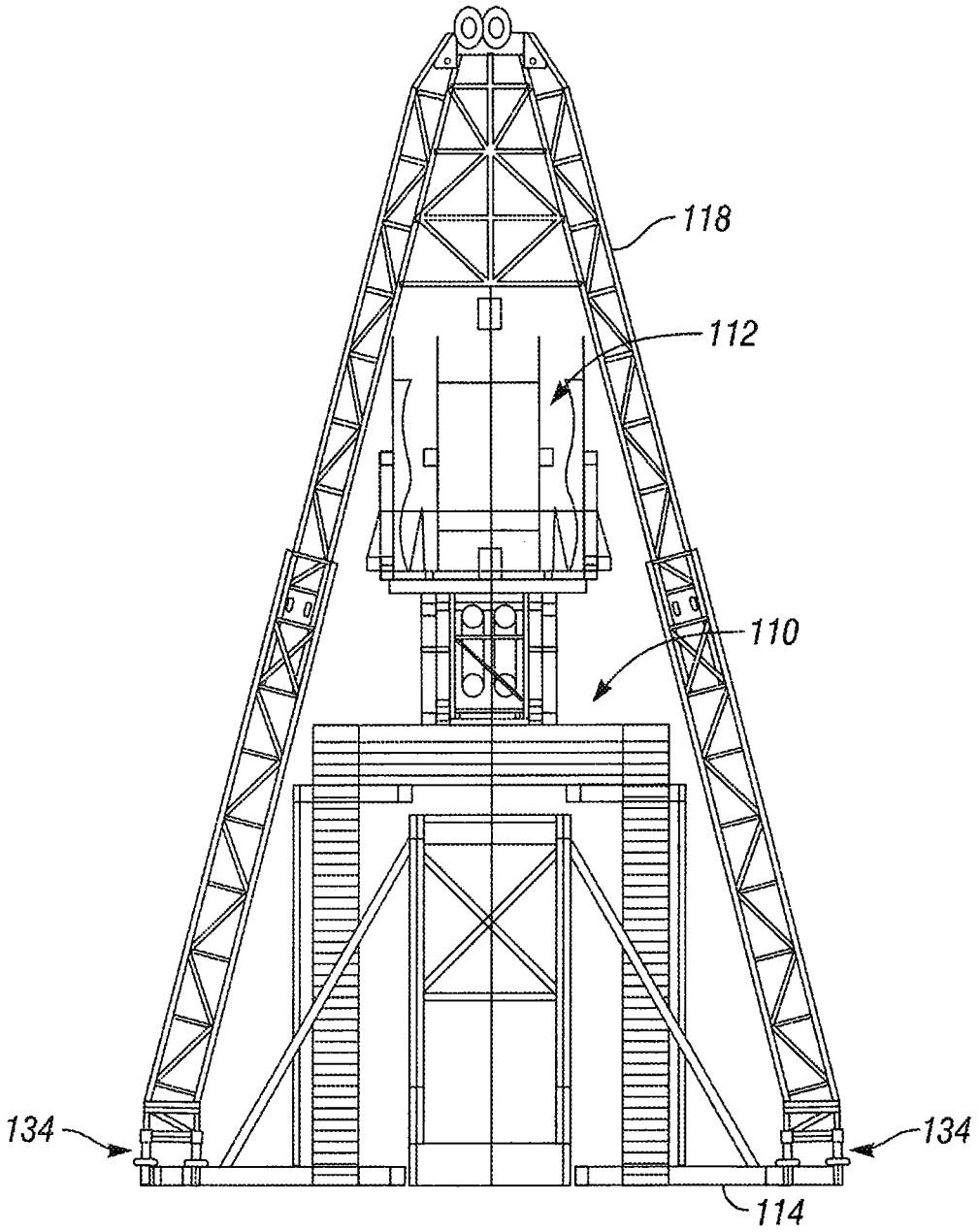

FIG. 12*a* illustrates that the upper floor (102, 106 & 116) is pivotally connected to the lower floor by a plurality of legs 122. The upper floor is pivoted into position, such as by winching, and locked with pins. For example, the mast 118 may be used to winch the upper floor into position. Additional bracing may be used as needed to support the upper floor. Preferably, the legs 122 provide about 27 feet of vertical clearance from the ground or lower rig floor. The upper floor has a footprint of approximately 39 feet long by 39 feet wide. FIG. 12*b* illustrates a front view of the raised mast 118. As shown, the reel assembly 12 and turntable 10 are adapted to rotate within the footprint of mast 118.

Figure 13:
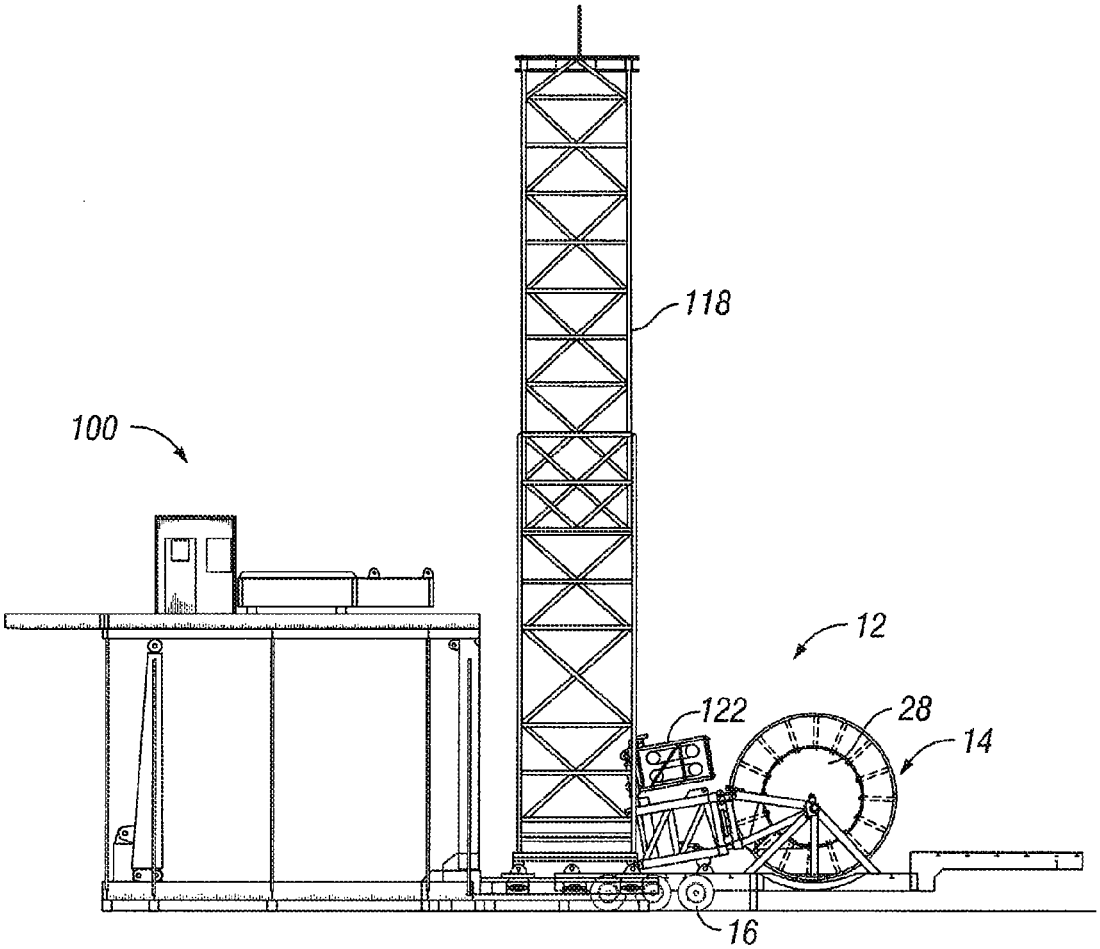
FIG. 13 illustrates delivering a reel assembly to a mobile rig.

FIG. 13 illustrates a reel assembly 12 delivered to the mobile rig 100. The reel assembly 12 may comprise a reel 28 containing coiled tubing 14, a support structure 16, a base 18, coiled tubing injector head 22, and counterbalance 26 (see, e.g., FIG. 2). Hydraulic cylinders on the reel assembly trailer may be used to raise and position the reel assembly 12 relative to the mast 118. It will be appreciated that for embodiments of the system that utilize a separate injector turntable 60, the injector 22 may or may not be a component of the assembly 12 as described.

Figure 14:
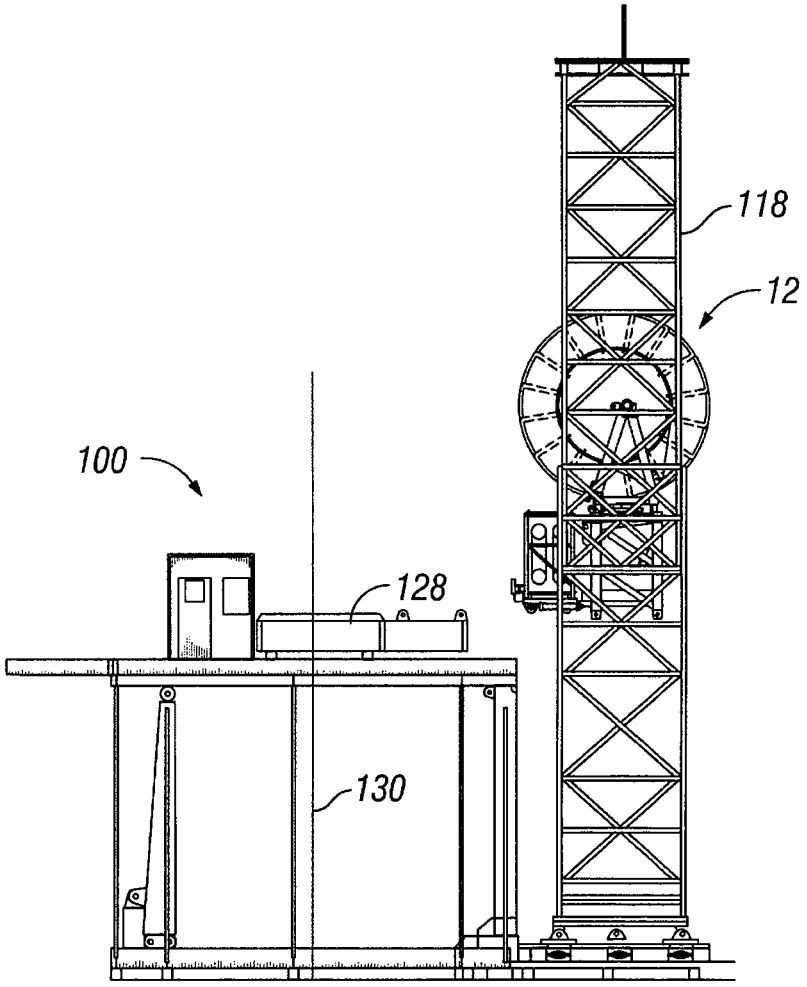
FIG. 14 illustrates raising a reel assembly above the upper floor of a mobile rig

FIG. 14 illustrates the reel assembly 12 being raised above the upper rig floor by the collapsible mast 118. A variety of means are available for raising the reel assembly 12, but it is preferred that the mast winch 150 be used to raise the assembly to the upper floor.

Figure 15:
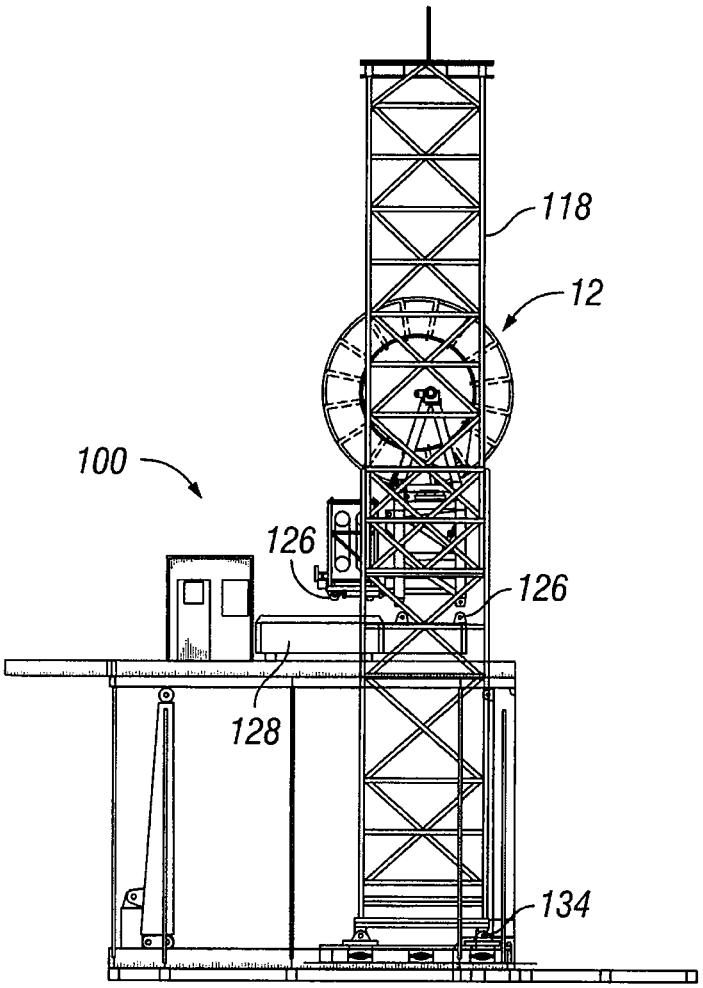
FIG. 15 illustrates positioning the reel assembly over the turntable assembly on a mobile rig.

FIG. 15 illustrates moving the mast 118 to center the reel assembly 12 over its mounting pads 126 on the turntable assembly 128. In the preferred embodiment, each mast 118 leg has a double winch drum. A cable is fed counterclockwise on one side of the drum and clockwise on the other drum. The loose cable ends are attached to mounts on the rig floor. The mast bottom 134 comprises Hillman rollers 136 (FIG. 11) that are hydraulically raised and lowered. When lowered, the double winch drums may be energized to move the mast 118 in the desired direction. Alternatively, a rack and pinion system, chain system, hydraulic cylinders or other similar devices can move the mast 118.

Figure 16:
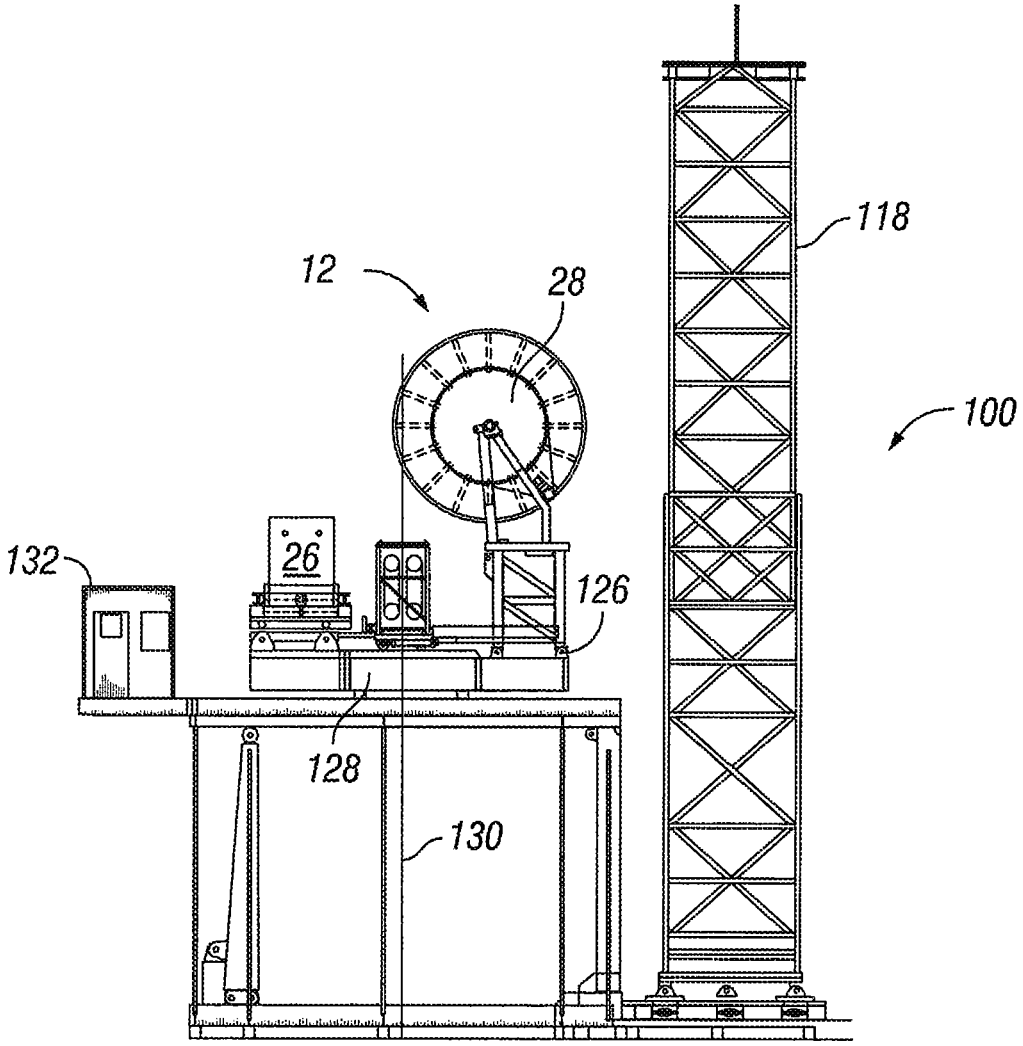
FIG. 16 illustrates a mobile rig with reel assembly, control house and mast in position.

In FIG. 16, the reel assembly 12 has been lowered into position and pinned to the mounting pads 126 on the turntable assembly 128. The reel assembly 12 is unpacked from its travel condition by shuttling the injector head 22 into position over the well site centerline 130. The injector head may be mounted on a track and moved by hydraulic cylinders, cable and drum or other such devices. For embodiments in which the injector head 22 is coupled to its own turntable 60, the injector may be moved into position over the injector turntable 60 and coupled thereto. Counter balance 26 is also deployed on the turntable assembly 128 opposite the reel 28. The control house 132 is also skidded or rolled into position. In the preferred embodiment, Hillman-rollers are used on the control house to aid in moving it into position. Once the reel assembly is in place, the collapsible mast 118 may be returned to the front of the mobile rig 100.

Figure 17:
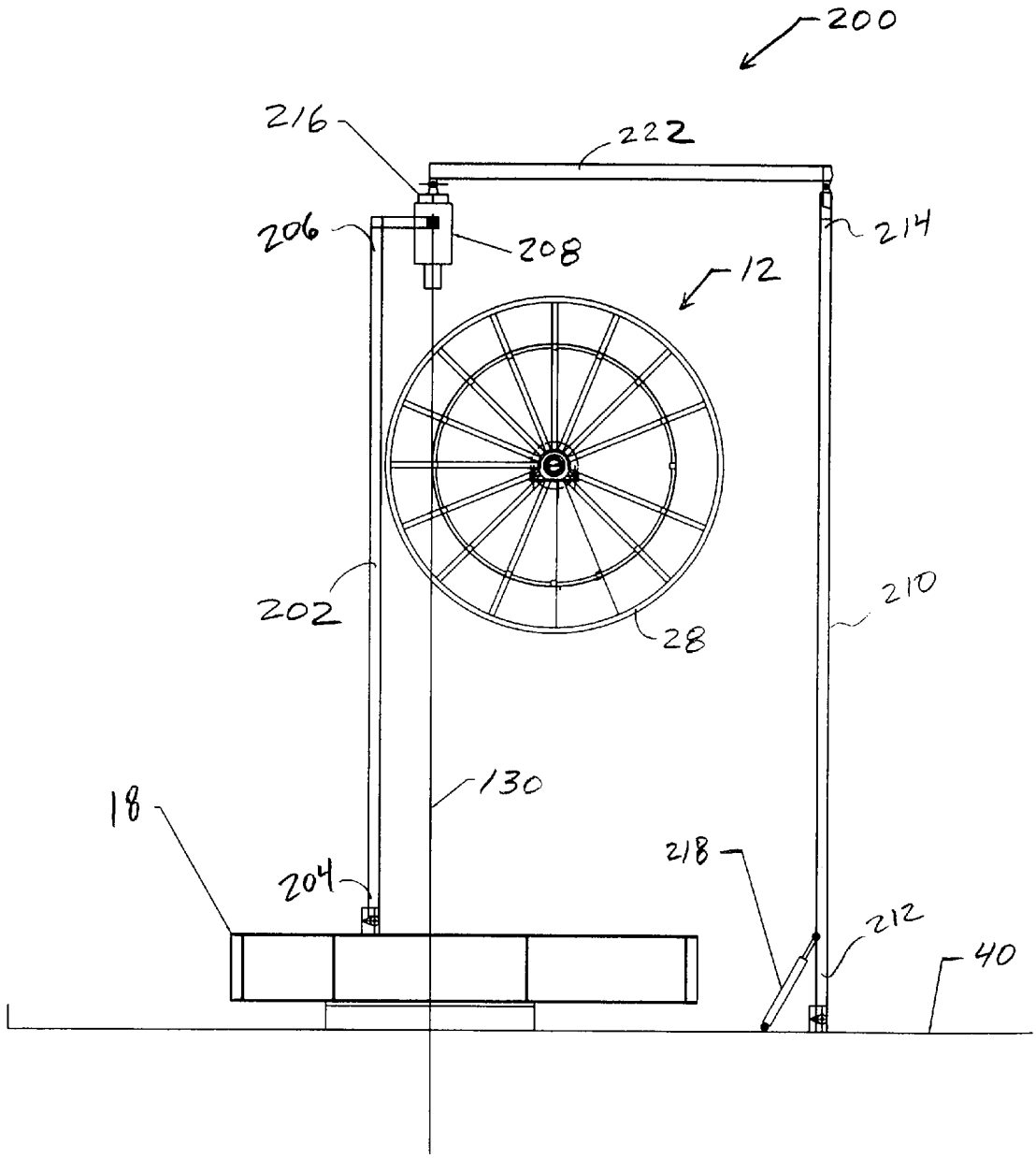
FIG. 17 illustrates one of many embodiments of the present invention having a swivel support assembly.

FIG. 17 illustrates one of many embodiments of the present invention having a swivel support assembly. In addition to the aspects described above, some embodiments of the present invention may include a system for managing operation lines, such as a swivel support assembly, which may include swivel assembly 200. Operation lines may include, for example, pneumatic lines, electrical lines, fluid lines or any line associated with a piece of well operations or other equipment situated about a well, such as control lines 24 (FIG. 1). The operation lines and equipment associated therewith may be supported, protected, carried by, enabled, integrated with, or otherwise managed by swivel assembly 200. At least a portion of one or more operation lines may pass through one or more components of swivel assembly 200, for example, through at least a portion of a rotary union device. The rotary union device may include passageways, which may be internal, external, integral or otherwise, as discussed in further detail below. The swivel assembly 200 may be used to situate the rotary union device about a well as required by a particular application, such as relative to the reel 28 or other parts of the reel assembly 12 (not shown), or, as another example, relative to the well. The longitudinal axis of the rotary union device preferably may be, but is not required to be, located near the longitudinal axis of the wellbore, such as being aligned or substantially aligned with well site centerline 130. This alignment may be advantageous for managing operation lines during well operations.

In at least one embodiment, swivel assembly 200 may include a support structure, which may be used, for example, to support and/or position one or more components of the swivel assembly 200. For example, the structure may support a rotary union device, such as swivel 208. Swivel 208 may be any swivel required by a particular application and may preferably be a single or multi-passage swivel, such as a rotary union capable of having operation lines, such as pneumatic, hydraulic or electrical lines (not shown), coupled thereto. The lines may pass directly through swivel 208, such as through a central passageway, or one or more lines may be integrated with swivel 208. For example, swivel 208 may include one or more inlets or outlets (not shown), wherein swivel 208 may allow the contents of a line to be communicated from an inlet to an outlet. As another example, one or more operation lines may be coupled to the top of swivel 208, such as to an inlet, which may allow the contents of the operation line to pass into swivel 208. The contents may then pass through swivel 208 and out of the bottom of swivel 208, for example, through an outlet, wherein the contents may enter an operation line coupled thereto and associated with a particular piece of equipment in the system. In at least one exemplary embodiment, swivel 208 preferably may be a multi-passage rotary joint, such as a twelve or eighteen-passage rotary joint from Rotary Systems Inc. (www.rotarysystems.com), or a similar manufacturer. For example, swivel 208 may withstand fluid pressure, such as 7500 psi, and/or may allow electrical current to pass therethrough, for example, 24 VDC. However, these are used as examples and swivel 208 may include any number or type of passages required by a particular application, in any combination.

Swivel assembly 200 may include one or more support members, which may include, for example, first and second main support members, for supporting swivel 208 and other equipment required by a particular application. A first main support member may include, for example, torque member 202, which may have a first end 204 coupled to the rotating base 18, or a piece of equipment located thereon, and a second end 206 coupled to the swivel 208, such as to the main body. A second main support member may include a positioning member 210, which may have a first end 212 coupled to the rig floor 40, or a piece of equipment located thereon, and a second end 214 coupled to the swivel 208, for example to the mandrel, or inner spindle 216. Support members 202 and 210 may be coupled to the swivel 208 directly, indirectly, or otherwise, and may include additional equipment, such as service platforms, ladders, or other equipment required by a particular application. For example, positioning member 210 may include a cross member 222, which may extend between end 214 and swivel 208. Cross member 222 may be integral with positioning member 210, or it may be coupled thereto, and member 222 may be coupled to the swivel 208 in any manner required by a particular application, such as by a pin connection. Cross member 222 may have additional uses, such as routing and/or supporting operation lines or other equipment, or, as another example, strengthening swivel assembly 200. The support members and other members may be coupled in any manner required by a particular application. For example, ends 204 and 212 of support members 202 and 210 may preferably be moveably coupled to the base 18 and floor 40, respectively, such as by hinges, pins or other connections.

Swivel assembly 200 may further include one or more adjustment members 218, such as a pneumatic cylinder, hydraulic cylinder or other device, which may be used to adjust the position of the assembly 200. For example, the adjustment member 218 may be coupled between the floor 40 and support member 210 and may be used to adjust the position of swivel 208 by changing the angles between the support members 202 and 210 and the floor 40. More specifically, the adjustment member 218 may be used to erect the assembly 200, such as to align, or substantially align, the longitudinal axis of the swivel 208 with the well site centerline 130. As other examples, the adjustment member 218 may facilitate one or more portions of the assembly 200 being moved out of the way, such as to provide or supplement access to the wellbore, taken down, or prepared for relocation.

Figure 18:
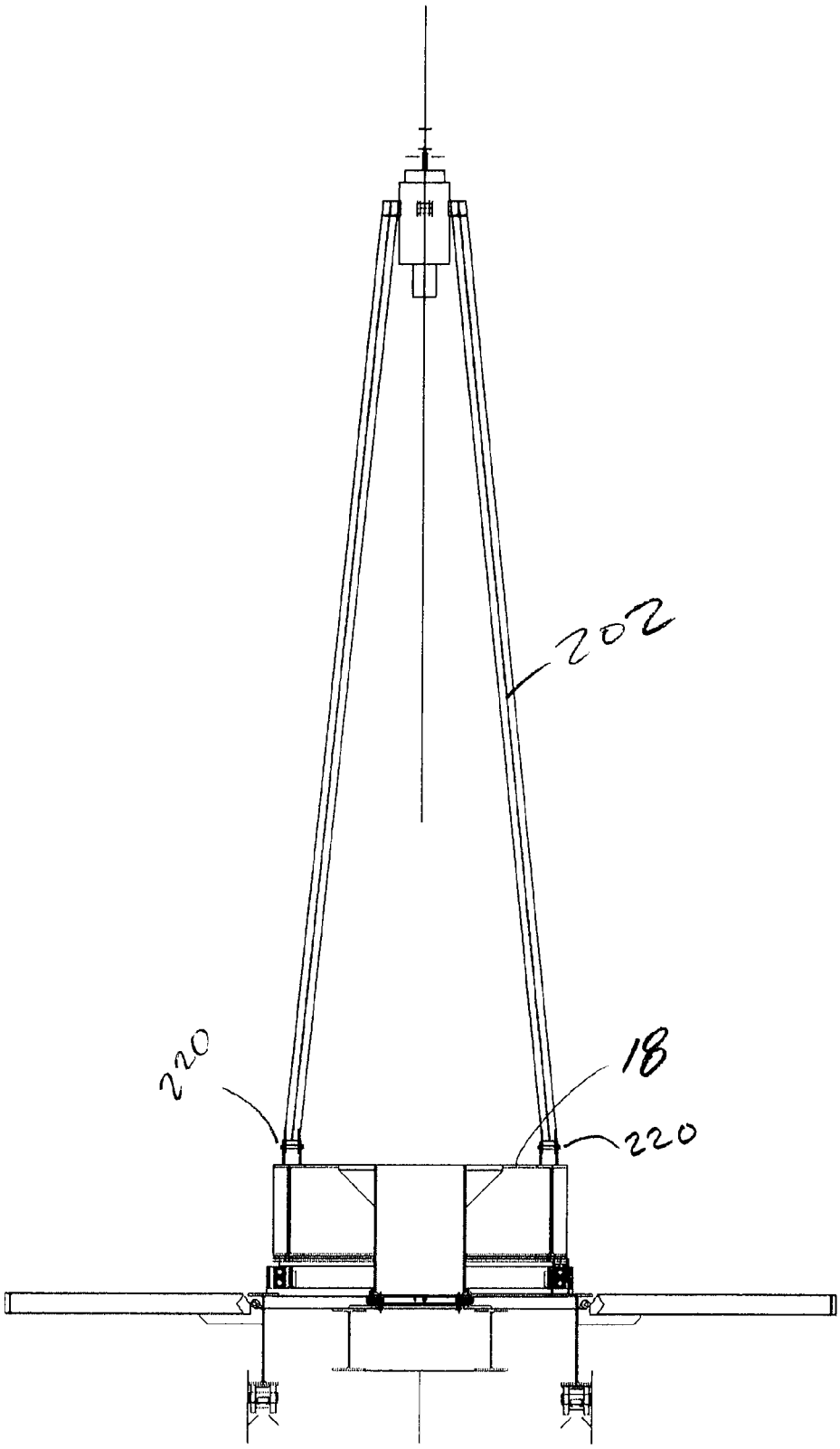
FIG. 18 illustrates a portion of the swivel assembly of FIG. 17.
Figure 19:
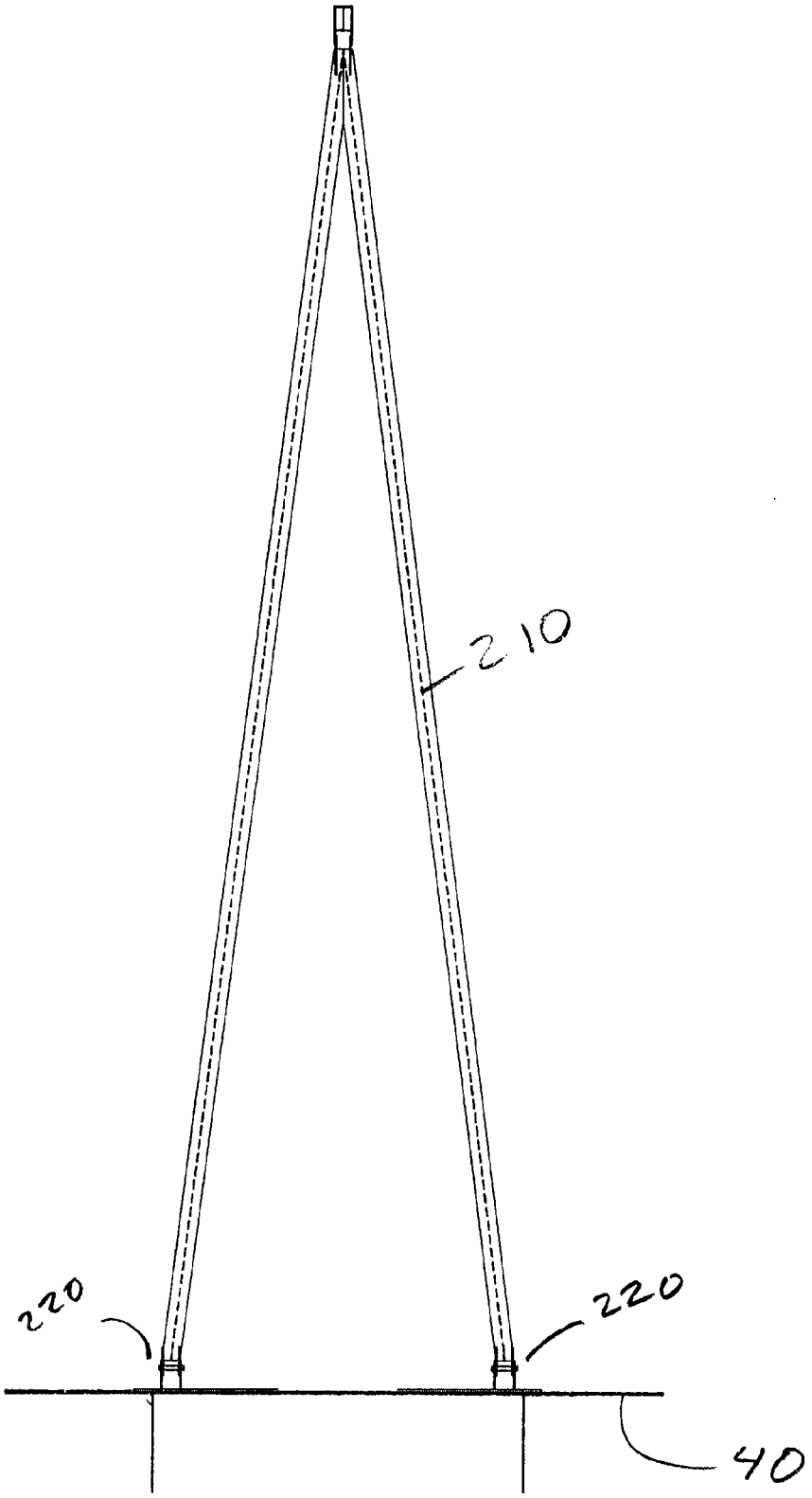
FIG. 19 illustrates another portion of the swivel assembly of FIG. 17.

FIG. 18 illustrates a portion of the swivel assembly of FIG. 17. FIG. 19 illustrates another portion of the swivel assembly of FIG. 17. These Figures will be discussed simultaneously. The structure of swivel assembly 200 may be of any shape, size or material required by a particular application. In at least one embodiment, members 202 and 210 may be, for example, metal frames, such as A-frames, which may be made from tubing, pipe or, as another example, metal bar. Members 202 and 210 may preferably be formed from steel I-beams, but may be formed from beams of any cross-section or material. Support members 202 and 210 may be coupled to the base 18 or floor 40 at their lower ends. For example, the connections 220 may be hinges, such as pins and receivers, or other devices. As another example, the connections may allow support members 202 and 210, and members or equipment associated therewith, to slide or otherwise move relative to the base 18 or floor 40. Connections 220, like all connections in swivel assembly 200, may be advantageous in the erection, take-down, or storage of one or more of the components. For example, when not in use, one or more components of swivel assembly 200 may fold down onto floor 40, such as to facilitate movement of the entire system to another location. The erection and folding of swivel assembly 200 may be automatic or manual and may be independent or otherwise. For example, mast 118 and systems associated therewith may be used to move swivel assembly 200, in whole or in part. Swivel assembly 200 may be manipulated in pieces or as one unit. For example, the components of swivel assembly 200, such as the operation lines or support members, may preferably remain coupled during take down and transport, but need not do so.

Figure 20:
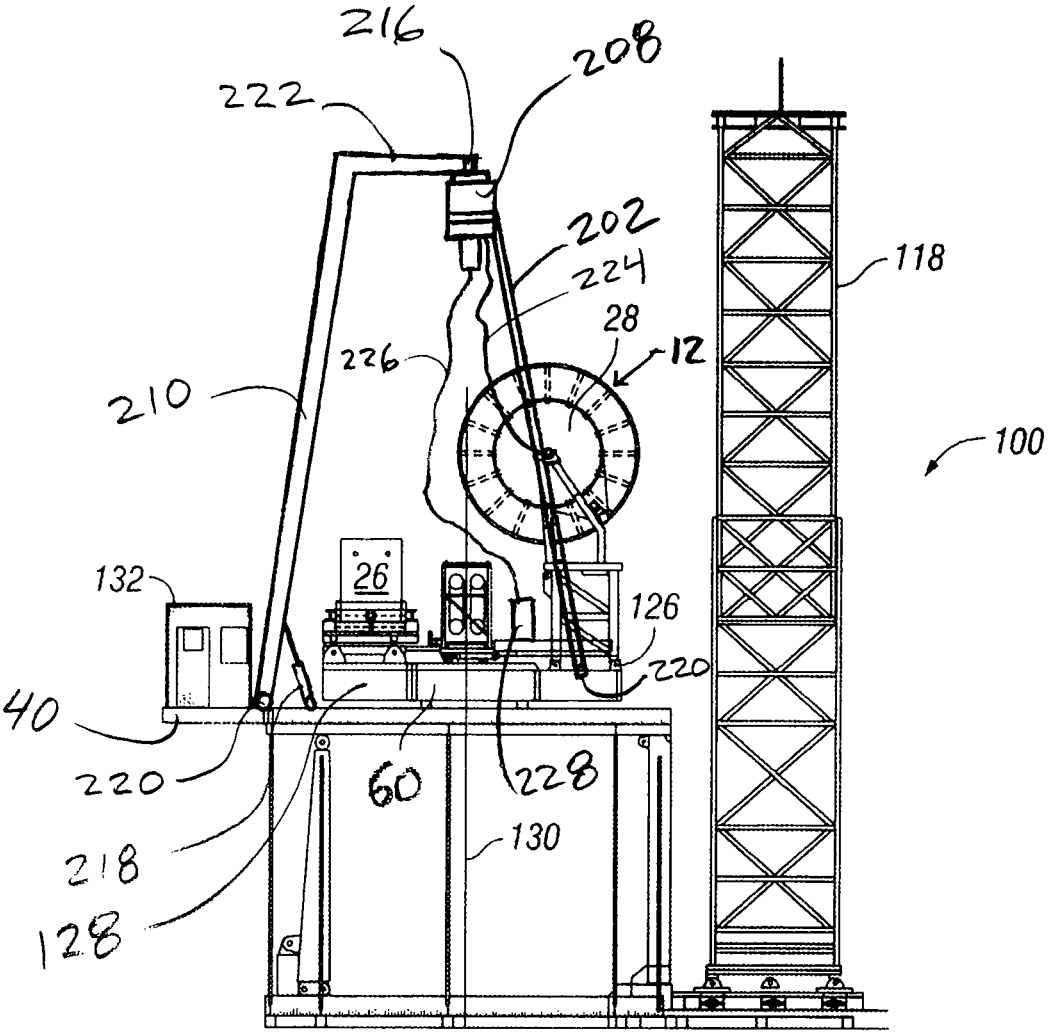
FIG. 20 illustrates one of many embodiments of the present invention having a swivel support assembly and utilizing other aspects of the present invention.

FIG. 20 illustrates one of many embodiments of the present invention having a swivel support assembly and utilizing other aspects of the present invention. The bottom end of torque member 202 may be coupled to a rotating platform, such as injector assembly 60, or preferably to turntable assembly 128 or a piece of equipment located thereon. The top end of torque member 202 may be coupled to swivel 208, such as to the main body. Torque member 202 may have many uses, for example, supporting equipment such as swivel 208 or transferring torque from turntable assembly 128 to the body of swivel 208. In at least one embodiment, such as the embodiment of FIG. 20, torque member 202 may spin along with turntable assembly 128 during operations, wherein at least some torque generated by the rotating turntable may be transferred to the body of swivel 208 by torque member 202. The bottom end of positioning member 210 may be coupled to the floor 40 or to a piece of equipment thereon. The top end of positioning member 210 may be coupled to the swivel 208, such as to the inner spindle 216. As well operations are carried out, various parts of the present invention may rotate, for example about well site centerline 130, such as turntable assembly 128 and, as other examples, torque member 202, at least a portion of swivel 208, such as the body, and at least a portion of one or more operation lines supported by swivel 208, such as those portions extending from the bottom of swivel 208 to a corresponding piece of equipment located on the turntable assembly 128. For example, at least a portion of operation line 224, which may be, for example, a line carrying fluids or other material to reel assembly 12, such as a kelly line routing fluid to coiled tubing (not shown), may rotate along with turntable assembly 128. As another example, operation line 226, which may be associated with any piece of equipment on the turntable assembly 128, such as interface panel 228, may also rotate, in whole or in part, during operations. Any number of operation lines may be routed to interface panel 228, including all or none of them. Alternatively, one or more operation lines may be otherwise routed to an associated piece of equipment, directly or indirectly. In at least one preferred embodiment, all operation lines other than the kelly line may be routed from swivel 208 to interface panel 228, where they may be organized or connected as required by a particular application and then, for example, routed to associated pieces of equipment.

Preferably, positioning member 210 does not rotate and may be used to position swivel 208 and/or other equipment relative to well site centerline 130, or as otherwise required by a particular application. For example, adjustment member 218 may be manipulated, such as lengthened or shortened, to hinge member 210 about a connection 220, which may change the angle between support member 210 and the floor 40. This movement may in turn cause other components to move, such as torque member 202, cross member 222, or swivel 208. Adjustments to the support members 202 and 210, the adjustment member 218, or any other components of the swivel assembly 200 may be made for any purpose and at any time. For example, an effort preferably may be made to keep the longitudinal axis of swivel 208 aligned or substantially aligned with the well site centerline 130, or to keep the swivel 208 and supported operation lines in another position required by a particular application. The adjustments may be made manually, automatically, such as through the use of computers, sensors or controllers, or otherwise, singularly or in combination.

Figure 21:
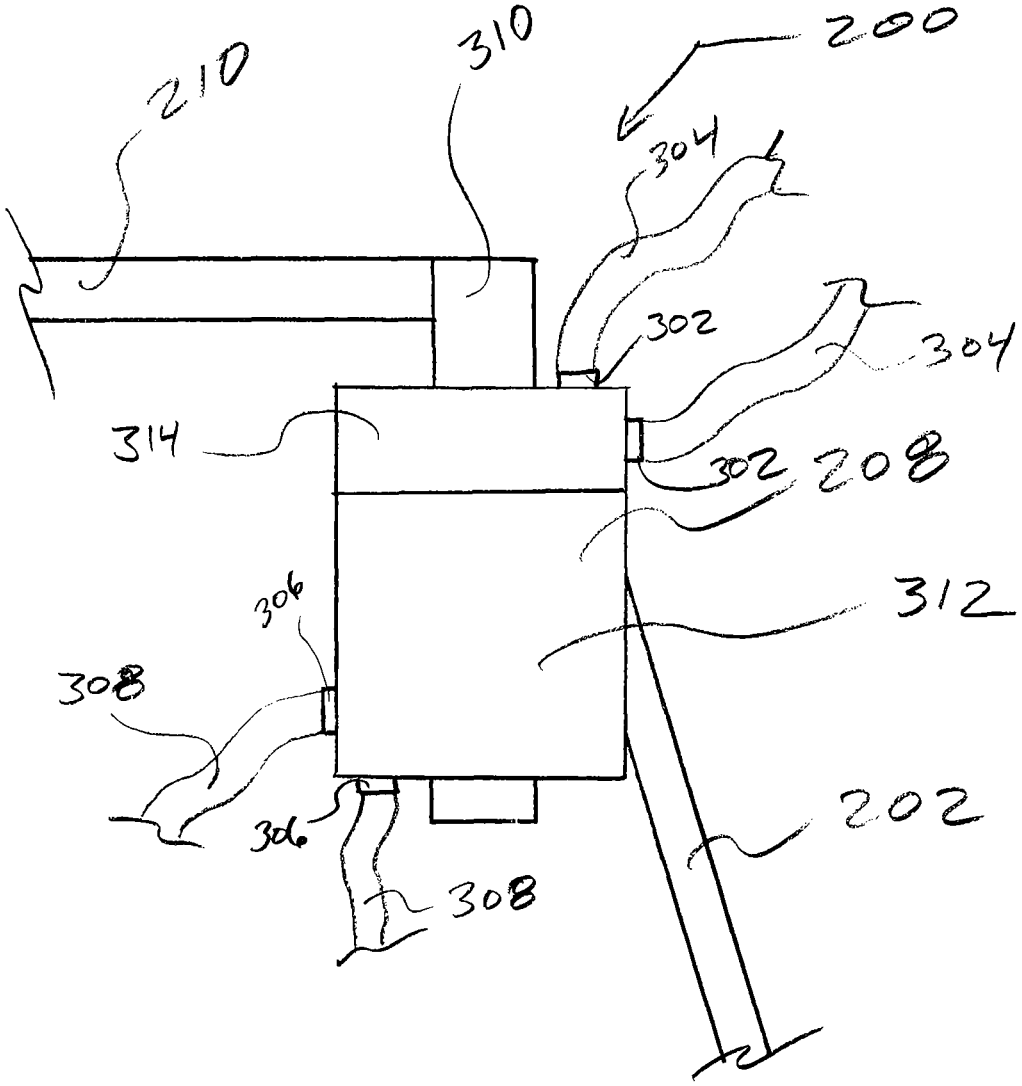
FIG. 21 illustrates another one of many embodiments of the present invention having a swivel support assembly and utilizing other aspects of the present invention.

FIG. 21 illustrates another one of many embodiments of the present invention having a swivel support assembly and utilizing other aspects of the present invention. As described above, swivel assembly 200 may include torque member 202, swivel 208, positioning member 210 or other components for managing operation lines. In at least one embodiment, swivel 208 may include one or more inlets 302 for coupling one or more operation lines 304 thereto. Each inlet 302 of swivel 208 may communicate with a particular outlet 306 required by a particular application. The inlets 302 and outlets 306 may include threads, connectors, or other couplers for coupling operation lines thereto, as required by a particular application. Operation lines 304 may carry, for example, fluids, such as hydraulic fluid or air, electricity, or anything required by a particular application to control or operate a particular piece of equipment (not shown) associated with a particular operation line. For example, the contents of each line 304 may enter inlet 302 and travel through swivel 208. The contents may exit swivel 208 through the associated outlet 306, wherein the contents may travel, for example, through another operation line 308, such as to an associated piece of equipment in the system. In other embodiments, for example, one or more operation lines may pass directly through swivel 208, but need not, such as through a central passageway in spindle 310, as required by a particular application. A particular embodiment may have any combination of passageways or operation lines required by a particular application. For example, the passageways may be integrated with or directly through swivel 208 and the operation lines may be hoses, tubes, pipes, or any lines required by a particular application, in whole or in part.

In the embodiment of FIG. 21, which is but one of many, torque arm 202 may be coupled to the lower portion 312 of swivel 208 and positioning member 210 may be coupled to spindle 310. The lower portion of positioning member 210 may be coupled to a non-rotating piece of equipment in the system (not shown), such as the rig floor or equipment associated therewith. The lower portion of torque arm 202 may be coupled to a rotating piece of equipment in the system, such as turntable assembly 128 or equipment coupled thereto. The components may be coupled in any manner required by a particular application, permanently, removably, or otherwise. During operations, for example, torque member 202 may spin or rotate, such as along with turntable assembly 128 (not shown). As torque member 202 rotates, for example, at least some of the torque causing torque member 202 to rotate may be transferred to swivel 208 by member 202, which may cause one or more other components of the system to rotate. For example, the lower portion 312 of swivel 208 and operation lines 308 may rotate along with torque member 202. Contrariwise, positioning member 210, spindle 310, operation lines 304 and the upper portion 314 of swivel 208 may not rotate. For example, the torque transmitted to swivel 208 from torque member 202 may be transferred to bearings or other components associated with swivel 208. Accordingly, operation lines 304 may remain stationary and may communicate their contents through swivel 208 to operation lines 308, which may rotate with, for example, the equipment associated with each line, torque member 202, or other equipment, such as turntable assembly 128.

FIGS. 1-21 have disclosed an improved system for drilling and/or servicing wells with rotating coiled tubing and while the intricacies of design details and have not been presented herein, those persons of ordinary skill in the art having the benefit of this disclosure will readily appreciate how such an improved system can be designed and implemented. It will now be appreciated that Applicants have created an improved coiled tubing system that combines the benefits of coiled tubing drilling with the ability to rotate the coil at up to about 20 RPM or higher in either direction. The improved system disclosed herein may be used with overbalanced wells or under balanced wells. With respect to under balanced wells, the entirety of the disclosure found in *Introduction to Underbalanced Drilling* by LEAding Edge Advantage, Ltd (2002), a complete copy of which may be found at www.lealtd.com, is incorporated by reference herein for all purposes.

A conventional snubbing unit may be used to make the improved systems substantially self-sufficient and capable of preparing and completing both underbalanced and overbalanced wells. It is anticipated that at least one embodiment of the present invention may be rigged up and operational within about six hours of arrival upon location. Because the coiled tubing is rotated, the improved system is less likely to be limited by frictional lock up, hole cleaning issues and weight to bit transfer. In addition, existing or conventional bottom hole assembly (BHA) technology may be used to great advantage with the present system. For example, it is expected that the improved system will be able to trip four times faster than a conventional jointed pipe rig while utilizing the same crew sizes as traditional coil tubing drilling operations. The improved system can be used with existing or conventional underbalanced separation units and perhaps most effectively with a fully integrated, mobile under balanced drilling (UBD) system.

In underbalanced applications, the BHA can be deployed using a conventional lubricator. A number of BHA options are available, from standard positive displacement motor applications through turbine to rotary steerable systems using either mud pulse technology or electro-magnetic while drilling (EMWD) options for a variety of drilling applications.

In practice, it is contemplated that the connection of the BHA to the coiled tubing is made and pressure tested. The BHA will then be run into the well to begin drilling. When tubing rotation is required, the reel of coiled tubing and, therefore, the coil tubing in the well can be rotated up to about 20 RPM or higher, if desired. If reactive torque is an issue, for example, then the reel can also be rotated in the opposite direction. While directional drilling, the rotation of the reel can be halted to facilitate the necessary change in well trajectory and once the necessary correction has been achieved the tangent section can then be drilled. All of the tripping and drilling may be performed without having to make jointed connections, thus maintaining steady state downhole pressure conditions and preventing down hole pressure transients from potentially damaging the reservoir and negating the benefits of underbalanced drilling.

While tripping out of the well, the system may back ream continuously without making or breaking connections back to the shoe to assist in well cleaning and to reduce the potential for stuck pipe. Once the bit is at the shoe, the rotation of the tubing may be halted if desired to prevent bit damage and the coiled tubing tripped to the surface while maintaining under balanced conditions. The BHA may be recovered and the system can either begin the rig down process or re-complete the well as the rig program dictates.

As mentioned, the present invention may be used with conventional bottom hole assemblies and mud motors in addition to conventional coiled tubing and rotary steerable assemblies. The ability to use a variety of BHA or options gives the present invention the capacity to reduce sinusoidal oscillations that are currently found with existing wells drilled with coiled tubing BHAs. The present invention may also be used with all manners of downhole drilling, logging, fishing, abandonment, production, and other tools or processes. In addition, the coiled tubing may be rotated in a direction opposite to the rotation of drill bit/motor to reduce the amount of drilling torque reacted by the tubing and may beneficially reduce the sinusoidal oscillations of tubing in the well.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A system for drilling or servicing a well with coiled tubing, comprising:

a rotatable base comprising a bearing system rotatably fixing the base to a floor, a reel assembly comprising a support structure adapted to support a reel of coiled tubing, the support structure comprising an alignment system to align the coiled tubing with the well as the coiled tubing is payed on and off the reel; the reel assembly located near a periphery of the base;

a coil tubing injector head disposed adjacent the reel assembly and aligned with the well;

a swivel support assembly having a swivel supported by first and second support members, wherein the first member is coupled to the base and the second member is coupled to the floor, and wherein the longitudinal axis of the swivel is situated in substantial alignment with the well;

a counterbalance assembly located on the base substantially opposite the reel assembly and moveable toward and away from the reel assembly to maintain balance of the rotatable base as coiled tubing is payed on and off the reel; and a motive system for turning the base and thereby transmitting torque to the coiled tubing in the well.

2. The system of claim 1, further comprising a second rotatable base to which the injector is coupled, and wherein the first rotatable base and the second rotatable base are capable of relative rotation there between.

3. The system of claim 2, further comprising a torque measurement system adapted to determine an amount of reactive torque on the tubing in the well.

4. The system of claim 2, wherein the injector head further comprises a transducer system that detects the orientation of the coiled tubing relative to a centerline of the well and generates one or more signals for energizing the alignment system to bring the coiled tubing back into alignment.

5. The system of claim 1, wherein the alignment system comprises a first set of one or more hydraulic cylinders that move the reel toward the well as coiled tubing is payed off and a second set of one or more hydraulic cylinders that translate the reel relative to the well as coiled tubing is payed off.

6. The system of claim 1, wherein the motive system comprises one or more hydraulic motors engaging a ring gear coupled to the base.

7. The system of claim 1, wherein the motive system causes the base to rotate at a speed of about 0 to 20 rpm and generate a torque on the coiled tubing of up to about 13,000 foot-lbf.

8. The system of claim 1, wherein the floor comprises a plurality of sections adapted to be repositioned for travel.

9. The system of claim 8, further comprising a mobile rig.

* * * * *